United States Patent [19]

Meier

[11] Patent Number: 4,691,654

[45] Date of Patent: Sep. 8, 1987

[54] LATERAL MOVEMENT FEED DOG FOR A SEWING MACHINE

[75] Inventor: Willi Meier, Karlsruhe, Fed. Rep. of Germany

[73] Assignee: Dorina Nähmaschinen GmbH, Fed. Rep. of Germany

[21] Appl. No.: 903,277

[22] Filed: Sep. 3, 1986

[30] Foreign Application Priority Data

Sep. 5, 1985 [DE] Fed. Rep. of Germany ..... 3531630

[51] Int. Cl.[4] ..... D05B 27/00

[52] U.S. Cl. ..... 112/303; 112/324

[58] Field of Search ..... 112/303, 324, 308, 121.15, 112/323, 459, 314, 315

[56] References Cited

U.S. PATENT DOCUMENTS

| | | | |
|---|---|---|---|
| 1,354,514 | 10/1920 | Seymour | 112/303 |
| 3,026,832 | 3/1962 | Taketomi | 112/308 |
| 4,619,214 | 10/1986 | Baruffa et al. | 112/315 |
| 4,633,796 | 1/1987 | Hoffmann-Glewe et al. | 112/314 |

FOREIGN PATENT DOCUMENTS

| | | | |
|---|---|---|---|
| 2085935 | 5/1982 | United Kingdom | 112/324 |

*Primary Examiner*—Werner H. Schroeder
*Assistant Examiner*—Andrew M. Falik
*Attorney, Agent, or Firm*—McGlew and Tuttle

[57] ABSTRACT

A feed mechanism for a sewing machine with a material feed dog includes a support for a feed dog which is attached thereto and which is slidably mounted on a feed link and is connected with a drive for its transverse motion that is controlled independently of the main shaft. To effect a low inertia drive, the drive includes a link mounted on a pin firmly fixed to the housing. The link has a bearing drive piece eccentrically positioned with respect to the pin and in drive-contact with the feed dog support. The drive piece comprises an eccentric that surrounds the pin and abuts against a side surface of the support, thus providing a simple drive mechanism. In order to ensure low-friction transmission, the side surface of the support which is in contact with the eccentric is constituted by an abutment piece and in addition, transmission is accomplished via a roller bearing surrounding the eccentric.

5 Claims, 3 Drawing Figures

LATERAL MOVEMENT FEED DOG FOR A SEWING MACHINE

FIELD AND BACKGROUND OF THE INVENTION

This invention relates, in general, to sewing machines and, in particular to new and useful lateral shifting device associated with the feed mechanism of a sewing machine.

A feed device of this kind is disclosed in German Patent No. 34 31 375. In that arrangement, the drive for the transverse movement of the feed dogs is provided by a step motor mounted on the feed link. Because the step motor is mounted on the feed link, although a very short transmission path is achieved, the weight of the step motor has to be moved concommitantly with the shifting of the feed dog and thus limits sewing speed.

SUMMARY OF THE INVENTION

The invention provides a feed device with a drive mechanism for the transverse motion of a material feed dog that does not increase the forces of inertia acting in the direction of feed. The arrangement pursuant to the invention provides for an extremely simple drive mechanism.

In accordance with the invention, the feed dog which is used to advance material past a reciprocating needle of the sewing machine is mounted on a support which is also slidable laterally of the general feed direction of the material. In accordance with the invention, the support includes a sliding piece which is biased against a transverse shifting drive mechanism which includes an eccentric formed as a part of a driven link which is mounted for eccentric rotation about a fixed pin. The link includes a quadrant which is driven from a motor through a drive gear fixed to the motor shaft to oscillate the link so as to cause the eccentric to move against the slide and cause a shifting of the slide against the biasing pressure of a spring which urges the slide against the eccentric. The eccentric is advantageously formed by a roller bearing which is arranged around the eccentric core.

Accordingly, it is an object of the invention to provide an improved drive for laterally shifting the feed dog of a sewing machine material feeder which includes mounting the dog on a slide which is shiftable transversely and separately driving the slide so that it is moved laterally with the use of a stepping motor acting to drive through an eccentric to cause the shifting motion.

A further object of the invention is to provide a feed drive for a sewing machine which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

GENERAL DESCRIPTION OF THE PREFERRED EMBODIMENTS

Figure 3:
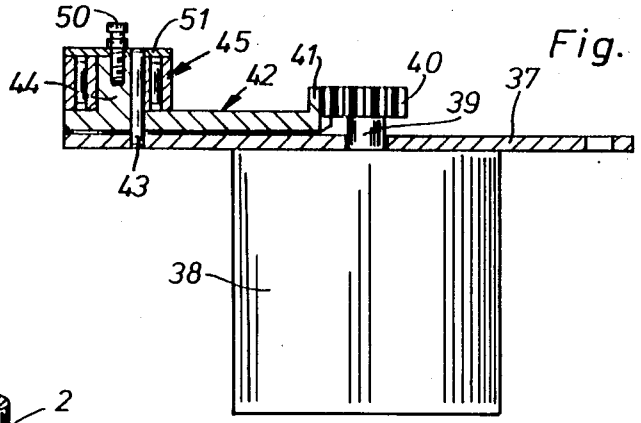
FIG. 3 is a sectional view tkaen along line III—III in FIG. 1.

Referring to the drawings, in particular, the invention embodied therein comprises a feed mechanism or drive which is superimposed on a feed dog 5 which operates on material to move it pas a reciprocating needle 3 carried by a needle bar 2. In accordance with the invention, the feed dog 5 is carried on a support 8 which is mounted for movement transverse to the feed direction of the material for the purpose of shifting the feed dog 4 transversely when such movement is required by the sewing operation.

Figure 2:
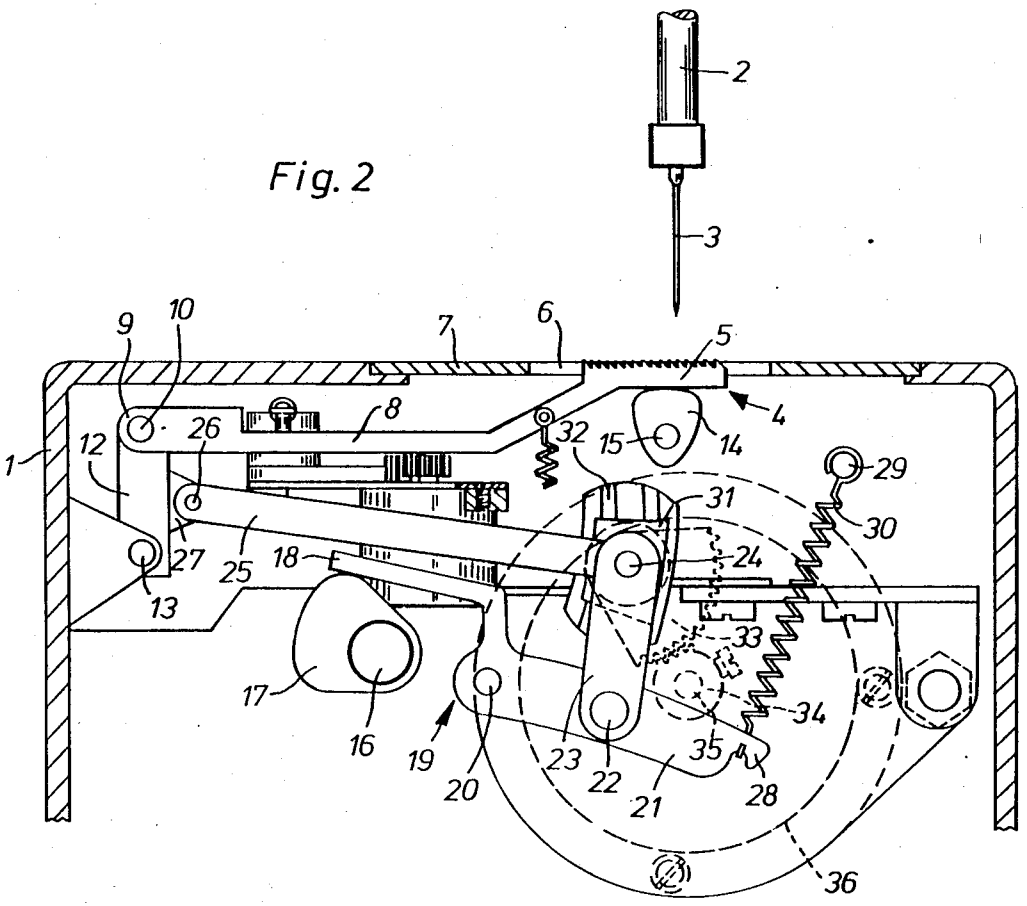
FIG. 2 is a sectional view through the lower arm of the sewing machine with the drive assembly.

FIG. 2 shows the portion of a feed mechanism situated in the lower arm 1 of a sewing machine together with a portion of the needle bar 2 in which a needle 3 is mounted. The needle bar 2 with the needle 3 cooperates in a conventional manner with a shuttle (not shown) mounted in the lower arm 1 to make stitches.

To move the material to be sewn, a material feed dog 5 is mounted in the lower arm 1 and equipped with ridges that protrude through a cut-out 6 in a needle plate 7 covering the lower arm 1 in the stitching area and act on the material.

Figure 1:
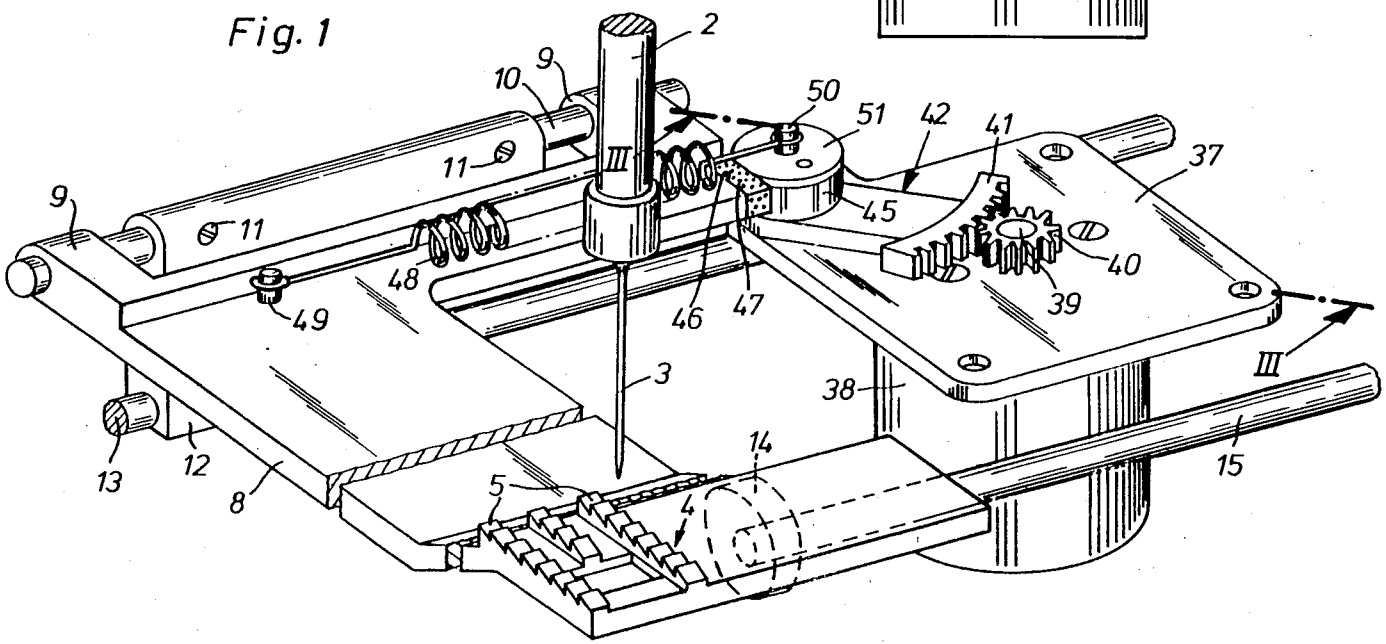
FIG. 1 is a diagrammatic representation of a drive assembly for the transverse movement of a material feed dog of a sewing machine constructed in accordance with the invention.

The feed dog 4 is firmly fixed to a support or arm 8 (FIG. 1) that is pivotally and slidably mounted on an axle 10 by means of lugs 9. The axle 10 is mounted by means of screws 11 in a hole in a feed link 12 that is pivotally supported on an axle 13 mounted in the lower arm 1. Underneath and touching the support 8 is a lifting eccentric 14, which is attached to a shaft 15 mounted in the lower arm 1 and connected with the drive of the sewing machine.

In the lower arm 1 is mounted a shaft 16 (FIG. 2) to which a profiled eccentric 17 is attached. The shaft 16 is connected in a conventional manner, not shown, with the drive of the sewing machine. On the profiled eccentric 17 rests one arm 18 of a double lever 19, which is seated on an axle 20 mounted in the lower arm 1. The other arm 21 of the double lever 19 is connected by means of a pin 22 to a connecting rod 23. The rod 23 is connected by a pin 24 to a push rod 25 that is linked at its other end by a bolt 26 to a lug 27 of the feed link 12.

A spring 30 suspended on an ear 28 of the double lever 19 and a bolt 29 mounted in the lower arm 1 forces the arm 18 of the double lever 19 against the profiled eccentric 17.

On the pin 24 is pivotally mounted a sliding block 31 that interacts with a slotted guide 32 in conventional fashion. The guide 32 is mounted on the end of an adjusting shaft (not shown), with which a toothed quadrant 33 is firmly fixed to a drive shaft 35 of a step motor 36 mounted in the lower arm 1.

A step motor 38 is firmly screwed into a plate 37 supported by the lower arm 1 (FIG. 1); to the motor's power take-off shaft is attached a pinion 40. The latter transmits power to a toothed quadrant 41 of a link 42 (FIG. 3), mounted on a pin 43 seated in the plate 37. An extension of the link 42 surrounding the pin 43 is designed as an eccentric 44 whose axis is outside the axis of the pin 43. On the eccentric 44 a needle bush or roller bearing 45 is turnably seated. A abutment piece 47 attached to one of the side surfaces 46 of the support 8 is pressed by the action of a tension spring 48 against the bush 45. The latter spring 48 is suspended by its one end on a peg 49 attached to the support 8 and on the other end of a bolt 50 which is the axis of the eccentric 44. The bolt 50 also serves to attach a disc on hub portion 51 that covers the eccentric 44 and provides an axial guidance of the needle bush 45.

When the sewing machine is in operation, the shaft 16 rotates, causing the profiled eccentric 17 via the double lever 19 and the connecting rod 23 attached therewith to move the sliding block 31 back and forth in the slotted guide. Depending on the angle adjustment of the slotted guide 32, which is predetermined by the step motor 36, the sliding block 31 pivots the feed link 12 via the push rod and thus conveys feed motions to the feed dog 4 whose extent and direction depend upon the angle position of the sliding block 32.

Upon the turning of the shaft 36, the lift eccentric 14 is driven via shaft 15 and conveys lifting motions to the feed dog 4.

In order to shift the material transversely to the normal feed direction, the step motor 38 drives the link 42 via the pinion 40, whereupon the eccentric 44 via the needle bush 45 and the abutment piece 47 moves the support 8 sideways counter to the action of the tension spring 48. The ridges of the feed dog 4 connected with the support A then move the material along with them. This shift occurs in time relationship with the feed movement of the feed dog 4, that is, during the phase when the ridges of the feed dog 4 are raised above the needle plate 7.

By interposing the needle bush 45 and appropriately constructing the abutment piece 47, e.g. making it out of a noise-muffling plastic, the transmission of the drive for sideways movement is accomplished largely without friction.

While specific embodiments of the invention have been shown and described in detail to illustrate the application of the principles of the invention, it will be understood that the invention may be embodied otherwise without departing from such principles.

What is claimed is:

1. In a sewing machine which includes a reciprocating needle and a feed dog for moving material through a feed path taking it past the needle, the improvement comprising a lateral feed mechanism including a support carrying the feed dog, means mounting said support for lateral movement, said support having a drive surface, a link pivotally mounted adjacent said drive surface and having an eccentric portion in engagement with said slide surface, slide drive means connected to said link to pivot said link so as to rotate said eccentric portion to cause lateral shifting of said support.

2. In a sewing machine according to claim 1, including means biasing said support so that the drive surface bears against said eccentric portion.

3. In a sewing machine according to claim 1, wherein said drive surface includes an abutment piece in engagement with said eccentric portion.

4. In a sewing machine according to claim 1, including a fixed plate mounted on the sewing machine wherein said slide drive means comprises a step motor engaged with said fixed plate, said step motor having a drive shaft with a driving gear, said link having a quadrant thereon in engagement with said gear and being oscillatable upon rotation of said driving gear to oscillate said link with said eccentric portion.

5. In a sewing machine according to claim 1 wherein said link has an eccentric hub portion and said eccentric portion includes said eccentric hub portion, and a roller bearing arranged around said eccentric hub portion.

* * * * *